US007128640B2

(12) United States Patent
Barous

(10) Patent No.: US 7,128,640 B2
(45) Date of Patent: Oct. 31, 2006

(54) DRUM FOR DRUM SANDER FOR SURFACE MOUNTING OF SANDPAPER BLANKS

(75) Inventor: Francis A. Barous, Dracut, MA (US)

(73) Assignee: Essex Silverline Corporation, Dracut, MA (US)

( * ) Notice: Subject to any disclaimer, the term of this patent is extended or adjusted under 35 U.S.C. 154(b) by 0 days.

(21) Appl. No.: 11/183,547

(22) Filed: Jul. 18, 2005

(65) Prior Publication Data

US 2006/0014481 A1 Jan. 19, 2006

Related U.S. Application Data

(60) Provisional application No. 60/588,913, filed on Jul. 16, 2004.

(51) Int. Cl.
*B24B 7/18* (2006.01)

(52) U.S. Cl. ..... 451/352; 451/496; 451/490

(58) Field of Classification Search ..... 451/352, 451/359, 496, 490, 507, 350
See application file for complete search history.

(56) References Cited

U.S. PATENT DOCUMENTS 1,395,468 A * 11/1921 Beal ..... 451/504
1,640,933 A * 8/1927 Gries ..... 451/352
2,375,102 A * 5/1945 Harris ..... 451/352
6,645,054 B1 * 11/2003 Raffo, Sr. ..... 451/182

FOREIGN PATENT DOCUMENTS

AU 219709 * 9/1957 ..... 451/496
GB 400754 * 11/1933 ..... 451/498

* cited by examiner

*Primary Examiner*—Robert A. Rose
(74) *Attorney, Agent, or Firm*—Maine & Asmus

(57) ABSTRACT

A powered floor sanding system with a rotating sanding drum having a drum core, to which is adhered a compliant sole and thereto a hook component material, using suitable adhesives; in combination with a sanding sheet having a loop fabric laminated to its backside with a high temperature adhesive so that the sanding sheet can be manually wrapped around the drum without special tools or other considerations, resulting in full surface area engagement of the hook and loop fastening materials with a butt joint of the sheet leading and trailing edges that does not overlap, and the sheet retains its grip on the drum for floor sanding operations under the weight of the floor sander at speeds up to 2800 rpm. There may be an alignment bar on the drum, not higher than flush. There may be a recess behind the bar for the leading edge of the sanding sheet.

27 Claims, 5 Drawing Sheets

DRUM FOR DRUM SANDER FOR SURFACE MOUNTING OF SANDPAPER BLANKS

This application relates and claims priority to pending U.S. application Ser. No. 60/588,913 filed Jul. 16, 2004.

BACKGROUND OF THE INVENTION

Powered disk and drum sanders are commonly known and used for sanding floors and other surface areas. Floor sanders designed specifically for floor surface applications are of the motorized drum sander type. Traditionally, the leading and trailing edges of a sheet of sand paper are secured within a slot on the drum by a paper edge gripping mechanism in order to hold the sand paper on the drum. There are other methods of doing it; such having three screws securing a bar that captures the butting edges of the sheet. The screws are known to come loose and scrap the floor. All of these methods rely on the butt joint as the point of security, the point where the sheet is attached to the drum. The remaining surface area of the sheet is wrapped around the drum but is not secured to the drum body or surface.

There are other methods of mounting disposable sanding material to sanders. One method employs a loop or belt of sand paper that must be slid over one end of the drum, where the drum is supported on the sander at its other end by a heavy bearing. The belts may be used in combination with drums of retractable diameters which are then expanded to hold the belt in place. The drum designs are complex, and often don't perform well due to the expansion mechanisms, causing excessive "chatter" in use and leaving undesirable marks on the sanded floor surface.

Other types of sanders such as hand held or bench mounted rotating disk sanders (as opposed to drum sanders) have been known to try to use hook and loop fastener materials such as Velcro® brand material to secure the sand paper to the flexible sanding pad. However, the load and load distribution are markedly different for a disk sander than for a drum. There is not the continuous weight of a floor sander bearing on the contact interface causing increased pressure and temperature at the sandpaper to pad attachment interface, there is no centrifugal force normal to the attachment interface attempting to dislodge the sandpaper from the pad, and there is no paper joint on the sanding disk exposed to the leading edge lip peeling action of the passage of sandpaper over the surface or floor being sanded. The contact area or pressure print of a rotating sanding disk to the floor is typically constrained to less than one side of the disk area, and so excludes the region of the point of attachment, at the center of the disk.

For all drum type floor sanders, the weight of the machine combined with the rotating drum works to remove material from the floor surface. In finishing or re-finishing operations, some skill is required to achieve a satisfactory result. As is well known, the sanding sheets are consumed by use and must be replaced frequently. There is some user resistance to the effort and attention to detail required to install new sanding blanks with the necessary precision on the drum, so better and easier mounting methods are sought.

It is unknown to this Applicant for portable drum type floor sanders used with sand paper sheets to achieve commercial success using a hook and loop fastener system such as a Velcro® brand material to secure a sand paper blank to a fixed diameter drum surface where a joint in the sheet must be exposed on the drum surface. The reasons why can be readily deduced by one skilled in the art: rotational speed, machine weight, inherent resistant in the abrading motion, exposed leading edge of the sandpaper blank at a joint the drum, effects of the resulting high heat, peeling and shear pressure on the fastening materials, and cost. It has been tried without success by others.

SUMMARY OF THE INVENTION

What is disclosed is a unique drum and sanding sheet configuration for attaching and using sand paper sheets or blanks to a fixed diameter drum by use of a hook and loop fastening system. The invention, in its simplest form, is a fixed diameter drum for a powered floor sander that has a somewhat compliant layer of dense material firmly attached by adhesive to a rigid drum core, and which is further uniquely modified by having its cylindrical surface being completed covered by a sheet of the hook component of a hook and loop fastener system, the backside of which is firmed attached to the compliant layer by a high temperature adhesive. The corresponding sanding sheets are backed or laminated with a loop component sheet or layer of fabric, using a high temperature adhesive, so that a sheet may be wrapped and attached by surface contact via the hook and loop interface over the full surface of the drum, with its sheet ends abutting in a joint line extending across the width of the drum, with the sanding surface exposed for sanding of a floor surface by weight of the sander and motor-driven rotation of the drum.

The invention is deceptively simple on its face, but not at all easily arrived at in practice. It was through extensive inventive efforts and experimentation that a practical solution to the problem posed by the prior art was developed and reduced to practice as elsewhere described herein and expressed in the appended claims.

Other objects and advantages of the invention will be apparent to those skilled in the art from the description and figures provided.

DETAILED DESCRIPTION OF THE PREFERRED EMBODIMENT

Figure 1:
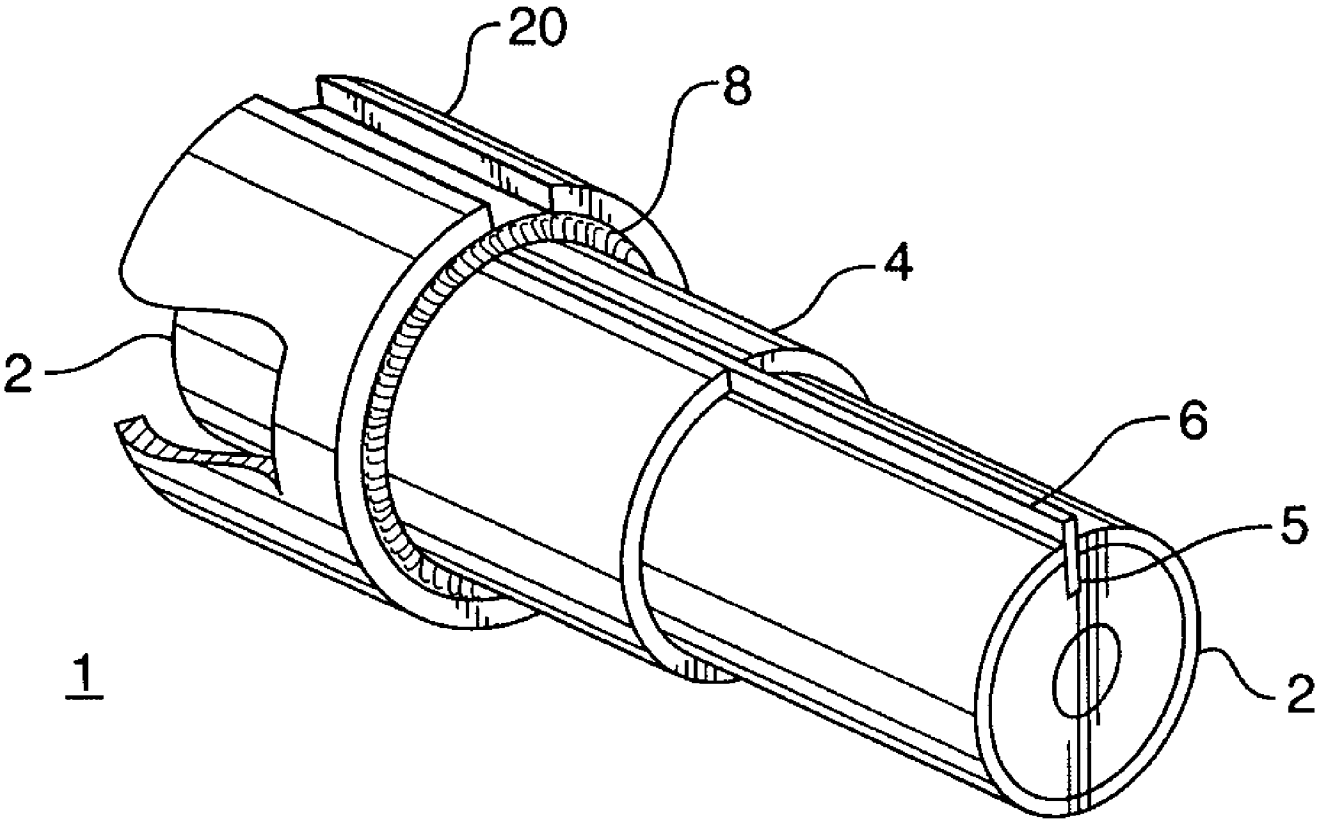
FIG. 1 is a perspective cut-away view of one embodiment of the invention, showing the metal drum core, alignment base plate, rubber sole, hook component of a hook and loop fastener system, for installation into a drum type, floor sander, and to which is attached a sandpaper blank by use of its loop component backing of the hook and loop fastener system, for floor sanding operations.
Figure 2:
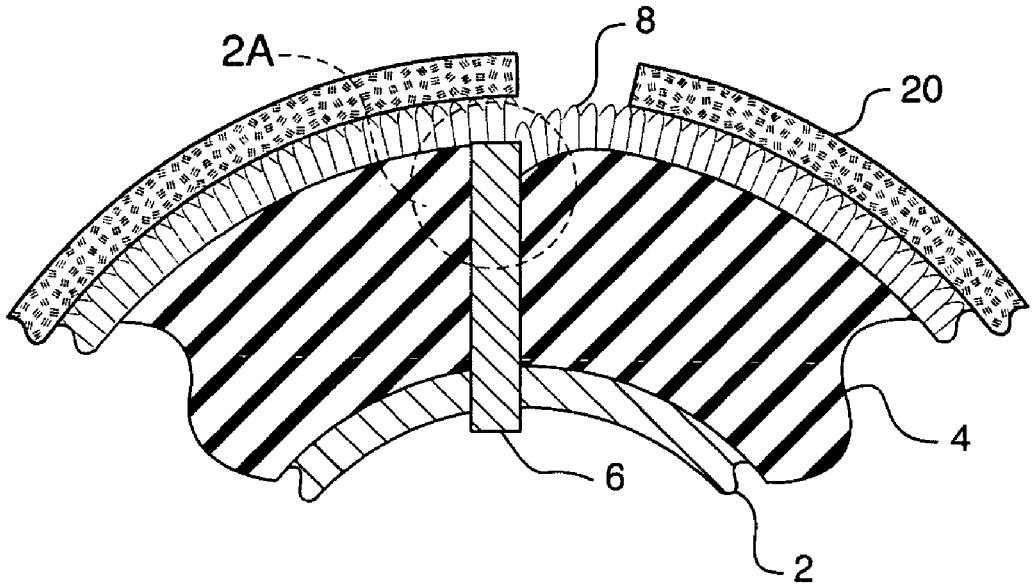
FIG. 2 is a partial cross section view of the FIG. 1 embodiment drum.
Figure 2A:
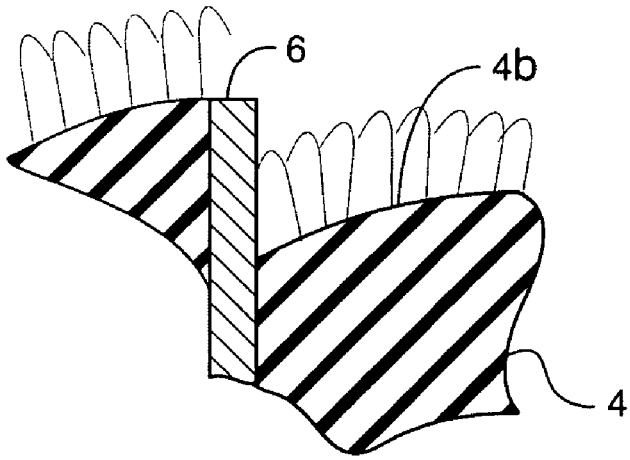
FIG. 2A is a close up partial view of FIG. 2, illustrating the ramp in the compliant substrate on the trailing side of the alignment plate.
Figure 3:
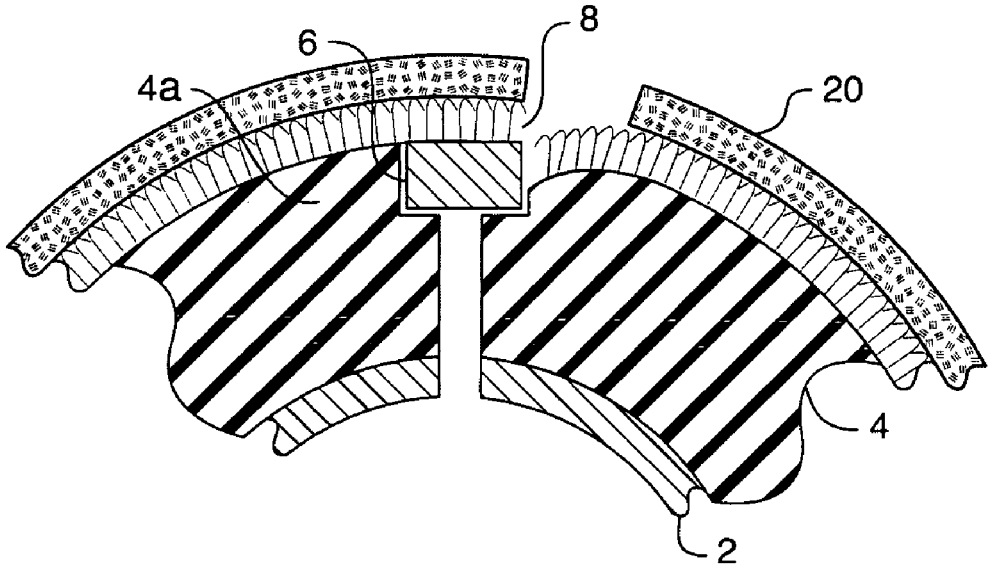
FIG. 3 is a partial cross section view of another embodiment drum, with an alternatively configured alignment bar or "base plate".
Figure 4:
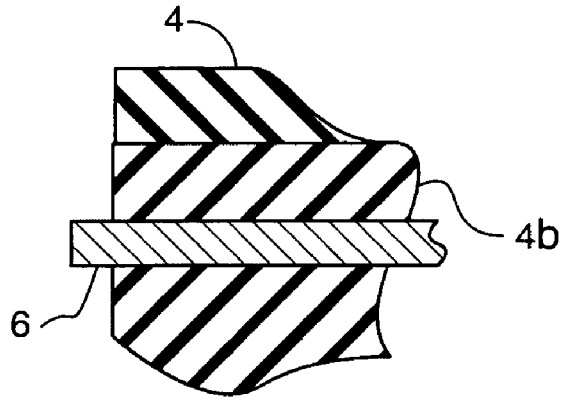
FIG. 4 is a topside partial view of the alignment bar indicating its slight extension beyond the drum end for visual alignment purposes.

The invention is susceptible of various embodiments. What follows are descriptions of preferred embodiments and should not be construed as limiting of the scope of the invention.

The Applicant, a manufacturer and supplier of industrial quality, drum-type, floor sanders for many years, recognized the long standing need to simplify the attachment of sanding sheets to the drum, to promote ease of use and greater productivity.

Referring to FIGS. 1–4, after considerable experimentation, a first workable embodiment was developed that has a soft rubber sole or compliant layer uniformly wrapped around a metal drum core and adhered to the drum core with a uniform coating of adhesive such as or equivalent to 3M brand Scotch-Grip brand 1300-L Rubber and Gasket Adhesive. There may be a metal bar termination strip set at a slight angle across the face of the sole to delineate the joint and abutting edge alignment of the sand paper sheets or blanks. The termination strip may be inserted into a slot in the rigid drum core and extend radially through the compliant layer, or it may lie exposed in a slot or depression in the compliant layer, isolated by the compliant layer from the drum core. There is a recess in the rubber sole or compliant layer on the trailing edge side of the alignment bar, which corresponds to the location of the leading edge of the sanding sheet when applied, and provides a slight depression for the leading edge of the sanding sheet as is further described below.

To the rubber sole or compliant layer there is adhered a sheet of high temperature tolerant, high strength hook material such as or equivalent to Velcro brand, Nylon, non-adhesive backed, style HTH 22 Hook, hook component material, adhered with a high performance adhesive such as or equivalent to 3M brand Scotch-Grip brand High Performance Contact Adhesive 1357. The sheet of thermoplastic hook material is positioned such that the trailing edge of the sheet is aligned with the leading edge side of the alignment bar, the hook material sheet wrapped around the rubber sole, and the leading edge terminating within the edge recess adjacent the alignment bar. The adhesive bond between the rubber sole and the sheet of fastener material is adequate to hold the hook component material in place, but is also manually peelable, facilitated by the use of a solvent such as acetone or other solvent suitable for the adhesive, for occasional replacement of the hook component material when wear or damage requires it. The adhesive provides a uniform grip over the full surface area of the hook component, holding it to the compliant layer of the drum, and tolerates the high heat and pressure of sanding, but remains peelable with the use of acetone for replacement when required.

The preferred embodiment sand paper sheet is a paper or fabric or composite paper/fabric-backed sanding sheet. Paper backed sanding sheets are normally provided for the floor sander rental market in grit numbers from #100 to #36; as are nylon reinforced paper backed sheets in grit numbers #20 to #12. Commercial grade sheets may have a resin over resin construction for greater durability under higher temperature and pressure and can be paper/fabric composites used in all grit sizes from smaller than #100 to as coarse or low as #16–4 or lower.

To the back side of the sanding sheet is laminated or adhered a 100% Nylon, low profile loop material fabric, of a weight of 3.0 oz. per square yard or 101.4 grams/meter2. It is laminated using a hot melt polyurethane adhesive capable of withstanding temperatures in excess of 300 F. The hook component and the loop fabric material of the fastener system each have a yet a higher temperature rating.

The drum and sheet combination is sized so that there is normally an intentional small gap between the trailing edge and the leading edge of the sanding sheet when wrapped on a new drum; which permits the rubber sole and drum assembly to be resurfaced to a slightly smaller diameter once or twice over the life of the drum and still accommodate the same size sanding paper blanks.

The placement of the sanding blank on the drum is important to assure a smooth wrap with fully functionally hook and loop engagement over the entire surface; especially at the leading and trailing edge or butt joint.

The size and speed of the drum rotation is preferably limited, such as to not more than 2800 rpm (rotations per minute), although speeds of not more than 2400 rpm are preferred, for 5½ and 7 inch diameter drums has been demonstrated to be effective without failure due to the centrifugal peeling force on the leading and trailing edge of the sandpaper sheet. Drum lengths of 8 to 12 inches have been demonstrated, although shorter and longer drum lengths are considered to be within the scope of the invention, up to the limit of drum core rigidity. The soft rubber sole or compliant layer in combination with the leading edge recess provides a smooth, chatter-free, trailing edge to leading edge transition for the sanding sheet during each rotation of the drum so that normal sanding operations are not affected by the joint line, and there is no visible affect in the results of the workpiece or floor being sanded.

Referring still to FIGS. 1–4, and 6 the construction of the Applicant's standard size 5½ inch diameter by 8 inch long drum 1 is illustrated. Normal drum rotation is counterclockwise with respect to the drum cross section views of FIGS. 2 and 3. A somewhat compressible circumferential sole or substrate 4, preferably a layer of rubber or polyurethane of about one half inch thickness and of about 22 durometer, or generally within a range of about 20–25 durometer inclusive, is disposed around drum core 2. The drum core is about 4½ inches or slightly larger in diameter. The compressible substrate is adhered to the drum over its entire cylindrical surface area using a layer of suitable adhesive 3. An alignment base plate 6, preferably an aluminum strip at least the length of the drum, and about ⅛ inch thick, is configured transversely across and within a slot 5 in the drum core and substrate 4 layer and running lengthwise of the drum.

The first working iterations of the invention used the existing slot 5 in the existing drum core design (a legacy of the former slot-grip mechanism) for installation of the base plate 6 so that it protruded radially from the drum core. Later embodiments oriented the base plate flatwise in a slot or recess 4A on the rubber substrate 4, providing more cushioning for the base plate. Accordingly, the base plate may be oriented radially or tangentially with reference to the drum, or simply be of square cross section and oriented tangentially. It may have a taper of between about 5 to 10 degrees, preferably 5½ degrees off square which will coincide with the slightly angular end cut on the abutting sheet ends as they wrap around the drum. At the right side of the baseplate 6 as viewed in FIGS. 2 and 3, the back side of the base plate, a leading edge ramp 4B is milled into or otherwise recessed in the substrate 4 layer, preferably about ¼ inch wide and sloped at about 30% from a surface tangent down to the backside of the base plate 6.

A conforming sheet 8 of high strength hook component material of a hook and loop fastener system, the "hook"

component, is aligned with the baseplate 6 and glued, using for uniform adhesive layer 7 the contact adhesive cited previously, to the rubber substrate 4 so as to be removable by careful peeling without significant damage to the rubber substrate, yet be securely enough attached to the rubber layer so as to provide a full surface gripping system for holding a loop fabric backed sandpaper sheet 20 to the drum for extended periods of floor sanding use. The baseplate 6 serves as the edge guide for initial alignment of the trailing edge of the sandpaper blank. The drum is run at preferably not more than about 2400 rpm, but it may be up to 2800 rpm, which limits the centrifugal force on the sandpaper sheet and still provides good rotary inertia and sanding action. Professional models may have larger drum diameters, up to 7 inches and more, and be operated at even lower speeds, for example as low as 1600 rpm or as high as 2800 rpm. Actual floor weight per surface area of the sanders thus equipped and operated may be as much as 145 psi (pounds per square inch), but is preferably closer to 50 psi. Floor weight per surface area is measured as the width times drum length of a contact line of a floor sander and revolving drum bearing on a steel plate coated with a layer of markover paint.

Other embodiments, examples and variations of the floor sander and drum component of the invention will be evident to those skilled in the art. For example, there is a drum for a drum sander consisting of a drum core attachable to a drum sander for rotatingly contacting a work surface such as a floor, to which is attached a compliant sole such as a rubber layer or substrate. There is an alignment bar embedded in the compliant sole not higher than flush with the surface of the compliant sole. There is a leading edge sloping recess in the compliant sole terminating at the alignment bar. There is a sheet of hook component fastener material aligned by one edge with the alignment bar and adhered around the drum to the compliant sole so as to conform the opposing edge of the base fastener to and within the sloping recess. There is a sanding material sheet, to the backside of which is laminated a nylon loop fabric with a high temperature adhesive, the sheet sized to abut the backside of the alignment bar and wrap fully around the drum so as to firmly and fully engage the hook and loop components over the full surface area of the drum.

Figure 5:
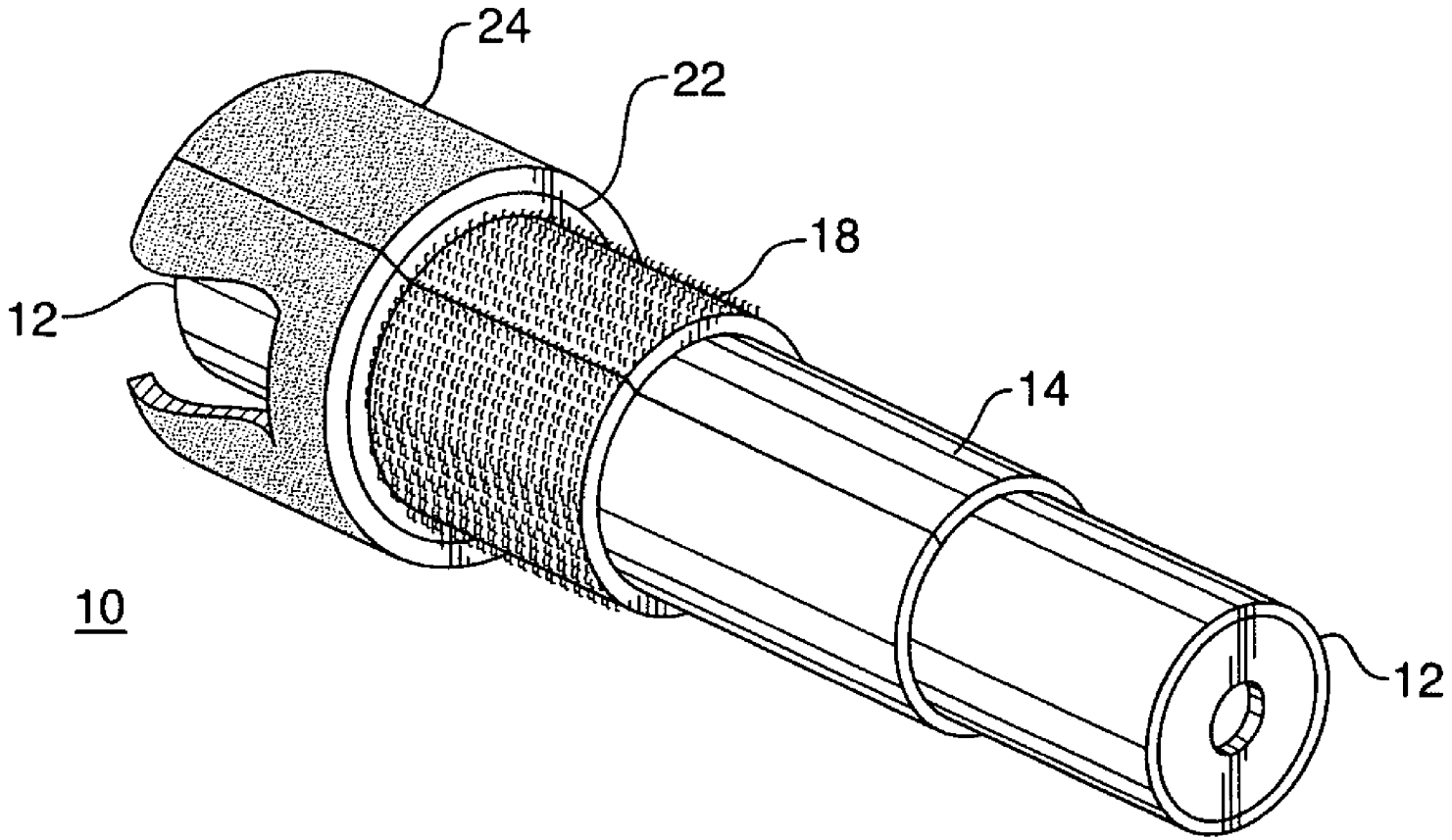
FIG. 5 is a partial perspective cut-away view of yet another embodiment of the invention, where the base plate and indentations of the FIG. 1 embodiment are not present.
Figure 6:
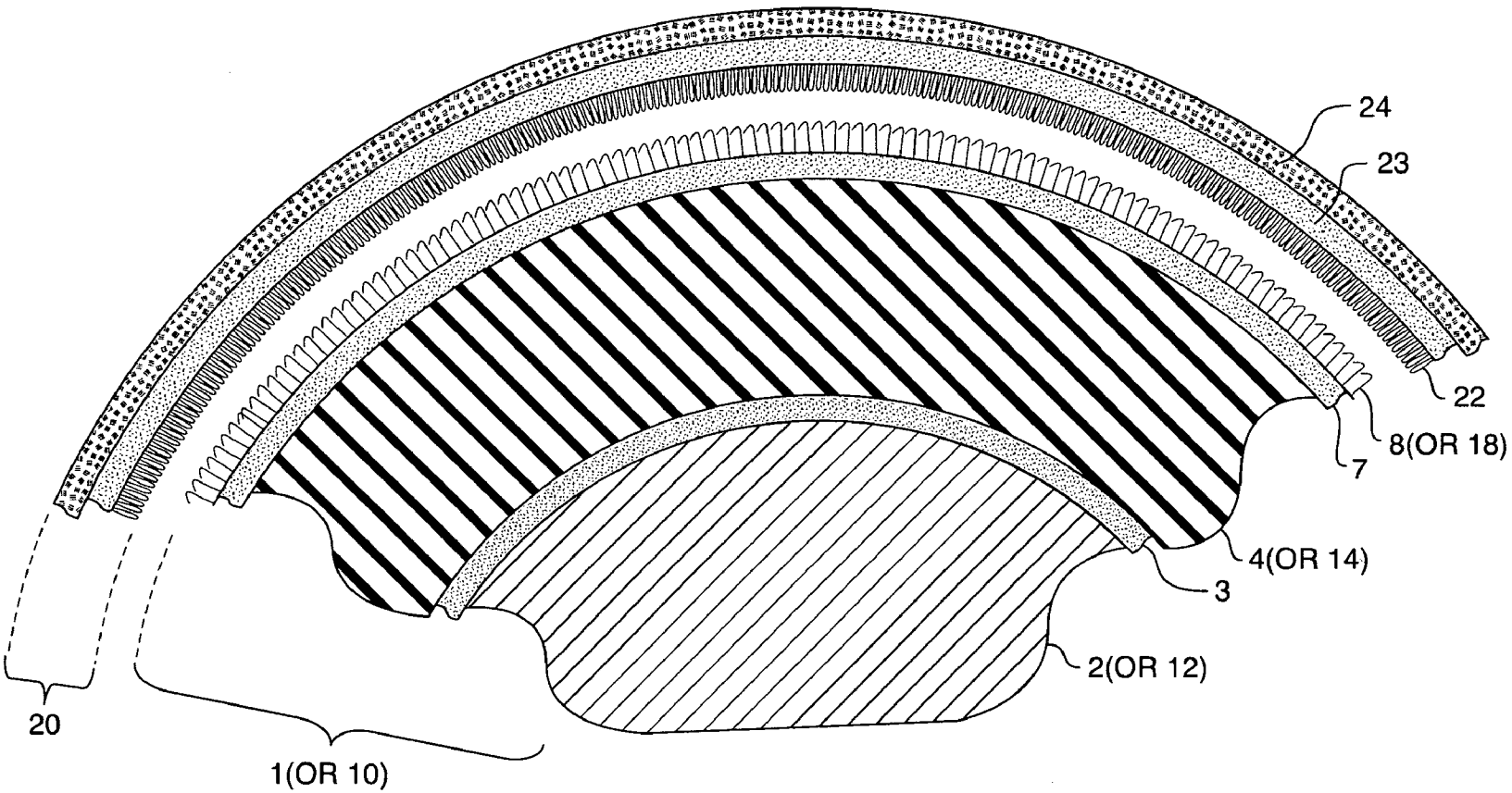
FIG. 6 is a partial cross section view of a drum and sanding sheet of the invention, illustrating in order the drum core, first adhesive layer, compliant substrate layer, second adhesive layer, and hook component layer of the drum; and the loop component layer, first adhesive layer, and sand paper layer of the sanding sheet.

Not satisfied with the above embodiments, Applicant conducted additional testing and experimentation attempting to further simplify the drum and the changing of sanding materials. Referring now to FIGS. 5 and 6, a further embodiment resulting from this continuing work is illustrated in another drum example. This drum is the same diameter as the drum of the prior example, however a larger 7 inch diameter has been tested as well, and 7 inch diameter by 12 inch long drums such as are made by the Applicant are within the scope of the invention. The drum 10 of this embodiment is a direct replacement for the Applicant's conventional drums that use the slotted gripping mechanism, for use in its drum type, floor sanders. Normal drum rotation is counterclockwise with respect to the perspective partial cutaway view of FIG. 5, although it will be appreciated that drum rotation in this embodiment can be in either direction with respect to the sanding sheet 20 attachment aspects of the invention as illustrated in FIG. 6.

The FIG. 5 drum embodiment is analogous to the embodiments of FIGS. 1–4 in several respects, but is clearly distinguishable in important respects. A somewhat compressible circumferential substrate 14, preferably a layer of high density foam rubber or polyurethane of about 20–25, preferably 22 durometer and about one half inch thick, is disposed around a drum core 12, using the adhesive layer 3 of FIG. 6 described previously for this purpose. There is no requirement for a slot or other variation to the otherwise uniformly smooth cylindrical surface of drum core 12. The alignment base plate of the earlier embodiment has been removed, allowing substrate 14 to completely wrap around the drum and terminate end to end with at a well-aligned, closely fitting butt joint that needs no particular angular offset, and can in fact be a square butt joint for convenience.

Applicant's further improvements and testing have demonstrated that there is no need for a ramp or indentation in this embodiment for the leading edge or trailing edge of the sanding blank, so substrate 14 is of uniform diameter including the area of its butt joint. A conforming sheet 18 of the same hook component of a high strength hook and loop fastener system as described in the above embodiment is adhered to the rubber substrate 14, using the same adhesive layer 7 of FIG. 6 described above. There being no ramp or indentation in substrate 14, sheet 18 is similarly applied with a smooth butt joint that may be square or may be set at a slight angle off square, and may be aligned with as shown in FIG. 5 but is preferably rotationally offset from the butt joint in substrate 14.

Referring now to FIG. 6, there is illustrated a partial cross section view of a drum and sanding sheet of the invention, illustrating in order the drum core, adhesive layer, compliant substrate layer, adhesive layer, and hook component layer of the drum; and the loop component layer, adhesive layer, and sand paper layer of the sanding sheet. For clarity, sanding sheet 20 is illustrated proximate to but not contacting drum 1; the loop material 22 of sheet 20 proximate the hook component 8 of drum 1 but not engaged or interlocked. Sanding sheets 20 are an important component of the invention, and comprises in one embodiment a paper-backed sanding sheet material 24 to which is laminated or adhered the low profile Nylon loop component fabric 22 of the hook and loop fastener system described previously, with the adhesive layer 23 described in the previous embodiment for this purpose, where the system components are specified to be relatively heat resistant and the hook and loop components sufficiently robust individually and in combination to withstand the heat and pressure of the floor sanding application.

Referring back to FIGS. 1–4 and FIG. 6, a sanding sheet 20 with its loop fabric backing is sized to wrap fully around drum 1 and be fully engaged with hook component 8, with its leading edge extending slightly into the recess 4B behind plate 6. There may be a gap between the trailing edge and the leading edge. There is no overlap.

Referring to FIGS. 5 and 6, a sanding sheet 20 with its loop fabric backing is sized to wrap fully around drum 10 and be fully engaged with hook component 8, and likewise terminate in an end to end well-fitted butt joint that may have an offset but may be a square joint, and may be aligned with the joint of substrate 14 and/or hook component 8 but is preferable offset or rotationally separated by at least a few degrees. The trailing edge to leading edge joint in sheet 20 may have a slight gap. There is no overlap.

It will be readily understood that the drum, under the weight and power of the floor sander, is driven in rotation and puts the sanding sheet and underlying layers of the drum in the area of contact of the drum to the floor under compression, while pulling the sanding sheet around by all of its hook and loop fastening interface against the resistance of the floor, so as to abrade the floor, removing material from the surface. A myriad of forces are at play at the nip and in the contact area between the drum and the floor, where the compression and drag are applied to the sanding sheet first, including its joint, and translated through the hook and loop interface to the compliant layer of the drum and hence to the drum core.

The thermoplastic hooks of these embodiments hook component 8 are molded in uniform rows and columns on a backing layer yielding a density of 900 hooks per square inch, rows defined as running with the roll or web of material as produced and columns as running across the roll as produced. The hook direction is oriented with the rows, 50% facing in one direction and 50% in the other direction, with hooks of either direction uniformly distributed within the array. The hook component sheets, sized for their respective drums, are cut from the supplied roll of hook component material so as to maintain or repeat the same orientation on the drum as was present in the roll; that is, the rows of hooks are wrapped and running around the drum, and the columns run across the face or length of the drum.

Maintaining the same orientation of the hook material from roll to drum has two benefits. First; the bending bias of the hook component backing layer resulting from the manufacturing and rolled packaging process is repeated on the drum, minimizing the introduction of any new bending stress in the hook component backing layer. Second, the hook component material is oriented with the plane of the hooks aligned with the direction of rotation, 50% facing in one direction and 50% facing in the other direction. Hence the hook material can be applied to the drum without regard to the intended direction of rotation. Consequently, drum 10, with respect to its hook component material, can be rotated in either direction with the same effective hook holding power.

Which ever way rotated, the resistance to rotation caused by the drag of the sanding paper tends to draw or pull the loop fabric component into further engagement with at least the forward facing hooks of the hook component material.

The thermoplastic hook material sheet 18 of this embodiment is as described in the embodiments above, but the scope of the invention includes variations from the specified hook engagement depth of 0.008 and hook height of 0.028 in., and 900 hook psi density that will provide an equivalent fastening power between the sanding sheet and the drum. Applicant's testing has demonstrated a peel line strength failure limit of 7–9 pounds per lineal inch of peel line for the described hook and loop attachment system of the invention, as measured by peeling a one square inch sample sanding sheet off a 5½ inch drum, staring along one of the one inch long edges. Preferred embodiments have a peel line attachment strength of at least 5 pound per lineal inch. The shear strength limit of the attachment system, analogous to the effect of floor resistance to drum rotation tending to pull the sandpaper along or over the drum surface, measured using a one square inch sample, was 24–26 psi. Preferred embodiments have a shear strength of at least 20 pounds per square inch. Centrifugal strength, pulling resistance normal to the attachment interface, using one square inch samples of sanding sheets attached to a drum in accordance with the invention, and superglued to a one square inch surface area pulling block, measured 22–23 psi at the point of failure, nearly the same as shear strength. Preferred embodiments have a centrifugal attachment strength of not less than 20 pounds per square inch.

Hook component sheet 8 or 18 is applied to respective substrate 4 or 14 with a uniform coating layer 7 of the previously specified adhesive. The adhesive is applied to the surface of the substrate, and the hook component sheet is then tightly wrapped on it and retained until the adhesive sets properly. The use of this type adhesive permits the hook material sheet to be manually removed for replacement by careful peeling from the corner of the joint edge, without damage to the compliant substrate. Yet the hook component is securely enough attached by the cured adhesive layer 7 to the substrate so as to hold a sandpaper sheet 20 to the drum for extended periods of floor sanding use.

As in earlier embodiments, the drum 10 style of drum is operated in the range of 1600 to 2800 rpm, which keeps the centrifugal force on the sandpaper sheets at acceptable levels and still provides good rotary inertia and sanding action. Professional models may have larger drum diameters, and be operated at lower speeds, preferably about 1600 rpm. Again, actual floor weight per surface area of the sanders thus equipped and operated may be as much as 145 psi (pounds per square inch), but is preferably closer to 50 psi.

Other embodiments are within the scope of the invention. For example, there is a powered floor sanding system consisting of a motorized floor sanding machine adapted to accept and rotate a sanding drum that consists of a drum core with a cylindrical surface to which is adhered by a first adhesive layer a compliant sole, to which is adhered by a second adhesive layer a hook component of a hook and loop fastener system so as to substantially encompass the drum with an outwardly exposed layer of the hook component cushioned by the compliant sole. There is a sanding sheet comprising a sand paper blank with a loop fabric component of the hook and loop fastener system laminated to the backside thereof using a loop fabric adhesive of high temperature tolerance. The sanding sheet is wrappable (may be manually wrapped around the drum) as previously described around the sanding drum such that the loop fabric component is fully engaged with the hook component, and the leading and trailing edges of the sanding sheet form a joint without overlap.

The hook component may consist of Velcro brand, Nylon, non-adhesive backed, style HTH 22 Hook material or other equivalent hook material. The floor sander may be operable within a range of 1600–2800 rpm. The drum may be configured with an alignment bar for mounting the sanding sheet. The drum may have a recess for the leading edge of the sanding sheet. The high temperature tolerance may be at least about a 300 F tolerance. The first adhesive layer may be 3M brand Scotch-Grip brand 1300-L Rubber and Gasket Adhesive or other equivalent adhesive. The second adhesive layer may be 3M brand Scotch-Grip brand High Performance Contact Adhesive 1357 or other equivalent adhesive. The loop fabric component may be 100% Nylon, low profile loop material fabric. The loop material fabric may have a weight of about 3.0 oz. per square yard. The loop fabric adhesive may consist of a hot melt polyurethane adhesive capable of withstanding temperatures up to at least 300 F.

The powered floor sanding system may have a weight of floor sander on drum and sanding sheet of within the range of 50 to 145 psi. The sanding sheet when fully engaged with the drum may be inseparable from the drum by a shear force of less than 20 psi.

I claim:

1. A powered floor sanding system comprising:

a sanding drum comprising a drum core with a cylindrical surface to which is adhered by a first adhesive layer a compliant sole, to which is adhered by a second adhesive layer a hook component of a hook and loop fastener system so as to substantially encompass said drum with an outwardly exposed layer of said hook component cushioned by said compliant sole; and a sanding sheet comprising a sand paper blank with a loop fabric component of said hook and loop fastener system laminated to the backside thereof using a loop fabric adhesive of high temperature tolerance, said sanding sheet being wrappable around said sanding drum such that said loop fabric component is fully engaged with said hook component, and the leading and trailing edges of said sanding sheet form a joint without overlap; and a motorized floor sanding machine adapted to accept the sanding sheet and rotate the sanding drum.

2. The powered floor sanding system of claim 1, said hook component comprising Velcro brand, Nylon, non-adhesive backed, style HTH 22 Hook material.

3. The powered floor sanding system of claim 1, said floor sander being operable within a range of 1600–2800 rpm.

4. The powered floor sanding system of claim 1, said drum configured with an alignment bar for mounting said sanding sheet.

5. The powered floor sanding system of claim 1, said drum having a recess for the leading edge of said sanding sheet.

6. The powered floor sanding system of claim 1, said high temperature tolerance being at least about a 300 degrees Fahrenheit tolerance.

7. The powered floor sanding system of claim 1, said first adhesive layer comprising 3M brand Scotch-Grip brand 1300-L Rubber and Gasket Adhesive.

8. The powered floor sanding system of claim 1, said second adhesive layer comprising 3M brand Scotch-Grip brand High Performance Contact Adhesive 1357.

9. The powered floor sanding system of claim 1, said loop fabric component comprising 100% Nylon, low profile loop material fabric.

10. The powered floor sanding system of claim 9, said loop material fabric having a weight of about 3.0 oz. per square yard.

11. The powered floor sanding system of claim 1, said loop fabric adhesive comprising a hot melt polyurethane adhesive capable of withstanding temperatures up to at least 300 degrees Fahrenheit.

12. The powered floor sanding system of claim 1, the weight per surface area of said floor sander on said drum and sanding sheet being within the range of 50 to 145 psi.

13. A powered floor sanding system comprising:

a sanding drum comprising a drum core with a cylindrical surface to which is adhered by a first adhesive layer a compliant sole, said first adhesive layer comprising 3M brand Scotch-Grip brand 1300-L Rubber and Gasket Adhesive, to which compliant sole is adhered by a second adhesive layer a hook component of a hook and loop fastener system so as to substantially encompass said drum with an outwardly exposed layer of said hook component cushioned by said compliant sole, said second adhesive layer comprising 3M brand Scotch-Grip brand High Performance Contact Adhesive 1357, said hook component comprising Velcro brand, Nylon, non-adhesive backed, style HTH 22 Hook material; and a sanding sheet comprising a sand paper blank with a loop fabric component of said hook and loop fastener system laminated to the backside thereof using a loop fabric adhesive of high temperature tolerance, said loop fabric adhesive comprising a hot melt polyurethane adhesive capable of withstanding temperatures up to at least 300 F., said loop fabric component comprising 100% Nylon, low profile loop material fabric, said sanding sheet being wrappable around said sanding drum such that said loop fabric component is fully engaged with said hook component, and the leading and trailing edges of said sanding sheet form a joint without overlap; and a motorized floor sanding machine adapted to accept the sanding sheet and rotate the sanding drum.

14. The powered floor sanding system of claim 13, said drum configured with an alignment bar for mounting said sanding sheet.

15. The powered floor sanding system of claim 13, said drum having a recess for the leading edge of said sanding sheet.

16. The powered floor sanding system of claim 13, said loop material fabric having a weight of about 3.0 oz. per square yard.

17. The powered floor sanding system of claim 13, the weight per surface area of said floor sander on said drum and sanding sheet being within the range of 50 to 145 psi.

18. A powered floor sanding system comprising:

a sanding drum comprising a drum core with a cylindrical surface to which is adhered by a first adhesive layer a compliant sole, said first adhesive layer comprising 3M brand Scotch-Grip brand 1300-L Rubber and Gasket Adhesive, to which compliant sole is adhered by a second adhesive layer a hook component of a hook and loop fastener system so as to substantially encompass said drum with an outwardly exposed layer of said hook component cushioned by said compliant sole, said second adhesive layer comprising 3M brand Scotch-Grip brand High Performance Contact Adhesive 1357, said hook component comprising Velcro brand, Nylon, non-adhesive backed, style HTH 22 Hook material; and a sanding sheet comprising a sand paper blank with a loop fabric component of said hook and loop fastener system laminated to the backside thereof using a loop fabric adhesive of high temperature tolerance, said loop fabric adhesive comprising a hot melt polyurethane adhesive capable of withstanding temperatures up to at least 300 F., said loop fabric component comprising 100% Nylon, low profile loop material fabric, said loop material fabric having a weight of about 3.0 oz. per square yard, said sanding sheet being wrappable around said sanding drum such that said loop fabric component is fully engaged with said hook component, and the leading and trailing edges of said sanding sheet form a joint without overlap, the weight per surface area of said floor sander on said drum and sanding sheet being within the range of 50 to 145 psi; and a motorized floor sanding machine adapted to accept the sanding sheet and rotate the sanding drum.

19. The powered floor sanding system of claim 1, said hook component comprising a high temperature tolerant, high strength hook material.

20. The powered floor sanding system of claim 1, said first adhesive layer comprising a high performance adhesive.

21. The powered floor sanding system of claim 1, said second adhesive layer comprising a high performance adhesive.

22. The powered floor sanding system of claim 13, said hook component comprising a high temperature tolerant, high strength hook material.

23. The powered floor sanding system of claim 13, said first adhesive layer comprising a high performance adhesive.

24. The powered floor sanding system of claim 13, said second adhesive layer comprising a high performance adhesive.

25. The powered floor sanding system of claim 18, said hook component comprising a high temperature tolerant, high strength hook material.

26. The powered floor sanding system of claim 18, said first adhesive layer comprising a high performance adhesive.

27. The powered floor sanding system of claim 18, said second adhesive layer comprising a high performance adhesive.

* * * * *